US008294367B2

(12) United States Patent
Herring et al.

(10) Patent No.: US 8,294,367 B2
(45) Date of Patent: Oct. 23, 2012

(54) SYSTEM AND APPARATUS FOR CATHODOLUMINESCENT LIGHTING

(75) Inventors: Richard N. Herring, Longmont, CO (US); Charles E. Hunt, Davis, CA (US); Thomas Skupien, Rockton, IL (US); Tomas Hasilik, Olomouc (CZ); Viktor Jelinek, Olomouc (CZ); Bernard K. Vancil, Beaverton, OR (US)

(73) Assignee: Vu1 Corporation, New York, NY (US)

( * ) Notice: Subject to any disclaimer, the term of this patent is extended or adjusted under 35 U.S.C. 154(b) by 474 days.

(21) Appl. No.: 12/558,221

(22) Filed: Sep. 11, 2009

(65) Prior Publication Data

US 2010/0097004 A1 Apr. 22, 2010

Related U.S. Application Data

(63) Continuation-in-part of application No. 11/969,840, filed on Jan. 4, 2008, now Pat. No. 7,834,553.

(60) Provisional application No. 61/096,665, filed on Sep. 12, 2008, provisional application No. 61/164,852, filed on Mar. 30, 2009, provisional application No. 61/164,853, filed on Mar. 30, 2009, provisional application No. 60/888,187, filed on Feb. 5, 2007.

(51) Int. Cl.
*H01J 23/16* (2006.01)
*H01J 29/96* (2006.01)

(52) U.S. Cl. ..... 315/3; 315/1; 315/5.32; 315/11; 315/12.1

(58) Field of Classification Search ..... None
See application file for complete search history.

(56) References Cited

U.S. PATENT DOCUMENTS 2,967,963 A 1/1961 Ballard et al.
4,129,801 A 12/1978 Soeno et al.
4,352,043 A * 9/1982 Rigden ..... 315/1
4,388,551 A 6/1983 Ray
(Continued)

FOREIGN PATENT DOCUMENTS

EP 0035828 A 9/1981
(Continued)

OTHER PUBLICATIONS

U.S. Appl. No. 11/969,840 Notice of Allowance mailed Jul. 12, 2010, 6 pages.

(Continued)

*Primary Examiner* — Anh Tran
(74) *Attorney, Agent, or Firm* — Lathrop & Gage LLP

(57) ABSTRACT

Electron sources for a cathodoluminescent lighting system are disclosed. An electron source is a broad-beam reflecting-type electron gun having a cathode for emitting electrons and a reflector and/or secondary emitter electrode and no grids. An alternative electron gun has a cathode having a heater welded to a disk, the disk having an emissive surface on a side facing a dome-shaped defocusing grid and an anode. A lighting system incorporating the electron sources has an envelope with a transparent face, an anode with a phosphor layer to emit light through the face and a conductor layer. The system also has a power supply for providing from five to thirty thousand volts of power to the light emitting device to draw electrons from cathode to anode and excite a cathodoluminescent phosphor, and the electrons transiting from cathode to anode are essentially unfocused. A power-factor-corrected embodiment is also disclosed.

26 Claims, 10 Drawing Sheets

U.S. PATENT DOCUMENTS

| | | | | |
|---|---|---|---|---|
| 4,506,191 | A | 3/1985 | Takenobu | |
| 5,552,659 | A | 9/1996 | Macaulay et al. | |
| 5,656,887 | A | 8/1997 | Voshell et al. | |
| 5,965,977 | A | 10/1999 | Makishima | |
| 5,986,399 | A | 11/1999 | Van Veen et al. | |
| 6,081,246 | A | 6/2000 | Cathey et al. | |
| 6,268,691 | B1 | 7/2001 | Takemura et al. | |
| 6,354,898 | B2 | 3/2002 | Kim | |
| 6,354,989 | B1 | 3/2002 | Nudeshima | |
| 6,404,136 | B1 | 6/2002 | Murray et al. | |
| 6,504,311 | B1 | 1/2003 | Kumar et al. | |
| 6,614,149 | B2 | 9/2003 | Kastalsky et al. | |
| 8,035,293 | B2 * | 10/2011 | Popovich | 313/496 |
| 2005/0156506 | A1 | 7/2005 | Chung et al. | |

FOREIGN PATENT DOCUMENTS

| | | | |
|---|---|---|---|
| EP | 0599202 | A | 6/1994 |
| GB | 2070849 | A | 9/1981 |
| GB | 2097181 | A | 10/1982 |
| WO | 2006066111 | A | 6/2006 |
| WO | 2008098008 | A1 | 8/2008 |

OTHER PUBLICATIONS

International Search Report and Written Opinion issued in related PCT Patent Application Serial No. PCT/US2008/053094, 16 pages, Jun. 6, 2008.

International Search Report and Written Opinion issued in related PCT Patent Application Serial No. PCT/US2008/053100, 17 Pages, Aug. 4, 2008.

International Search Report and Written Opinion issued in related PCT Patent Application Serial No. PCT/US2005/45713, 12 pages, Jun. 12, 2008.

Office Action issued in related U.S. Appl. No. 11/684,303, 15 pages, Jun. 11, 2008.

International Search Report and Written Opinion issued in related PCT Patent Application PCT/US2009/056684, dated Dec. 30, 2009, 14 pages.

Select File History of U.S. Appl. No. 11/969,840, dated Jan. 11, 2010 through Apr. 19, 2010, 43 pages.

* cited by examiner

SYSTEM AND APPARATUS FOR CATHODOLUMINESCENT LIGHTING

RELATED APPLICATIONS

This application claims priority to provisional patent applications: U.S. Patent Application 61/096,665, filed Sep. 12, 2008; U.S. Patent Application 61/164,852, filed Mar. 30, 2009; and U.S. Patent Application Serial No.: 61/164,853, filed Mar. 30, 2009, the disclosures of which are incorporated herein by reference.

This application is also a continuation-in-part of U.S. patent application Ser. No. 11/969,840, filed Jan. 4, 2008, which claims priority to U.S. Patent Application Ser. No. 60/888,187, filed Feb. 5, 2007, the disclosure of which is incorporated herein by reference.

FIELD OF THE INVENTION

The present application is related to a lighting device having a defocused cathode-ray device and driving circuitry, and also to a lighting device having an enhanced power factor.

BACKGROUND OF THE INVENTION

Typically, lamps used for general lighting utilize a tungsten filament that is heated to generate light. This process, however, is generally inefficient because a significant amount of energy is lost to the environment in the form of extraneous heat and non-visible, infrared and ultraviolet radiation. Other alternatives for general lighting include fluorescent lamps and light emitting diodes. While more efficient than incandescent lamps having tungsten filaments, fluorescent lamps tend not to have pleasing spectral characteristics, and light emitting diodes tend to be expensive.

It has been known for at least a century that electrons accelerated by high voltage in a vacuum, otherwise known as cathode rays, can cause compounds known as phosphors to emit light when the electrons strike those compounds. Much cathode ray tube (CRT) effort over the last century has been aimed towards apparatuses using tightly focused, deflectable electron beams for selectively exciting such phosphors for use in television, radar, sonar, computer, oscilloscope and other information displays; these devices are hereinafter referenced as data display CRTs. CRTs have not typically been used for general lighting purposes.

Data display CRTs typically have deflection circuitry for steering electron beams, and have such tightly focused electron beams that operation without deflection may "burn" their phosphor coating, causing permanent damage to the CRT. Such CRTs are often, but not always, operated by high voltage power supplies linked to their deflection circuitry.

Voltage multipliers driven by inverters have been used to provide the high voltage required to accelerate electrons in data display CRTs. For example, U.S. Pat. No. 5,331,255 describes a DC-to-DC converter having an inverter operating at about 1 MHz driving a Cockroft-Walton voltage multiplier to produce high voltage for driving a small data display CRT.

Electronic loads, such as compact fluorescent lamps, also tend to draw current spikes, primarily at voltage peaks of the incoming AC waveform. These current spikes cause the loads to have a poor "power factor," which can cause inefficiency in a power system.

Devices that use a stream of electrons to excite a phosphor typically require at least one electron source. Thermionic cathodes are commonly used for generating an electron beam for use in CRTs, electron microscopes, x-ray tubes, and other applications. In common use in CRTs, the goals are usually high current, rapid modulation of the emitted beam, tight focus, and stable emission. The cathode is typically a component of an electron gun that emits, focuses, and modulates the emitted beam.

SUMMARY OF THE INVENTION

Electron sources for a cathodoluminescent lighting system are disclosed. An electron source is a broad-beam reflecting-type electron gun having a cathode for emitting electrons and a reflector and/or secondary emitter electrode, and no grids. An alternative electron gun has a cathode having a heater welded to a disk, the disk having an emissive surface on a side facing a dome-shaped defocusing grid and an anode. A lighting system incorporating the electron sources has an envelope with a transparent face, an anode with a phosphor layer to emit light through the face and a conductor layer. The system also has a power supply for providing from five to thirty thousand volts of power to the light emitting device to draw electrons from cathode to anode and excite a cathodoluminescent phosphor, and the electrons transiting from cathode to anode are essentially unfocused. A power-factor-corrected embodiment is also disclosed.

In an embodiment, a direct-heated thermionic flood-emission cathode for use in the light emitting device has a heating element having an inverted "U" shape with a flat top and a flat substrate attached to the flat top of the heating element. On a surface of the substrate opposite its attachment to the heater is an emissive coating.

In another embodiment, a light emitting device has an electron gun having a cathode and a heating element with a flat substrate attached to a flat top of the heating element. On a surface of the substrate opposite its attachment to the heater is an emissive coating. The heater is supported on two metal heater bars. The gun also has a metal extraction ring aligned with the emissive material, a metal field-forming ring aligned with the metal extraction ring and positioned further from the emissive material than the metal extraction ring, and a metal grid having a convex shape and other parts for supporting electrodes of the gun. The light emitting device also has an envelope coated with anode and phosphor.

In another embodiment, a cathodoluminescent lighting system has an envelope having a transparent face with an anode and phosphor screen formed on it, and a reflecting electron gun for emitting electrons in a broad pattern; and a power supply for supplying at least two thousand volts between the cathode and the anode of the cathodoluminescent light emitting device. In this embodiment, electrons passing from cathode to anode are essentially unfocused.

DETAILED DESCRIPTION OF THE EMBODIMENTS

Figure 1:
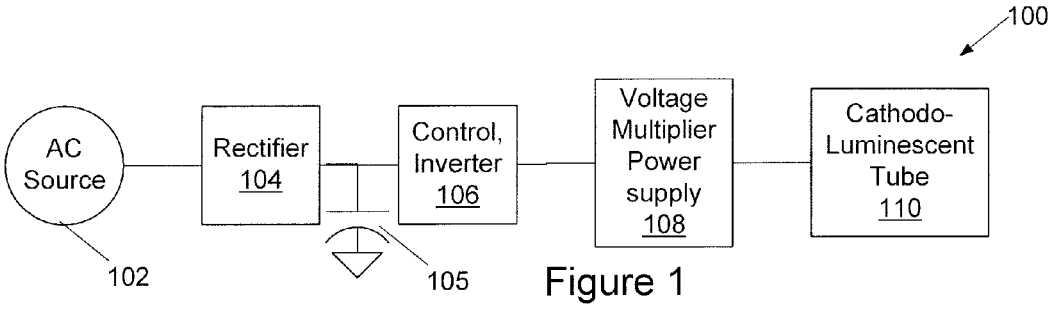
FIG. 1 is a block diagram of a lighting system embodying a cathodoluminescent lighting device with power factor correction and dimmer controllability.

As shown in FIG. 1, a cathodoluminescent lighting system 100 (see FIGS. 1-4) is powered by an external AC power source 102. AC power from the power source 102 is rectified by a rectifier 104, which may be a bridge rectifier (see FIG. 3), into DC power and filtered by a capacitor 105. In embodiments operating from a 120-volt AC power source 102, a resulting DC voltage can be approximately 160 volts. Filtering components may also be present in the rectifier 104 to prevent undesirable emissions from being coupled back into the power source 102, and to protect the cathodoluminescent lighting system 100 from spikes and surges to AC power source 102. DC power is input to a controller-inverter unit 106, to provide high frequency AC power. High frequency AC power in turn feeds a voltage-multiplying rectifier 108 to provide high voltage suitable for powering a cathodoluminescent tube 110 and, in another example, low voltage to power a cathode heater of the cathodoluminescent tube 110 (see FIG. 3, element 168) and, in other examples, an intermediate voltage to power a reflector and/or secondary emitter electrode of the cathodoluminescent tube 110.

Figure 3:
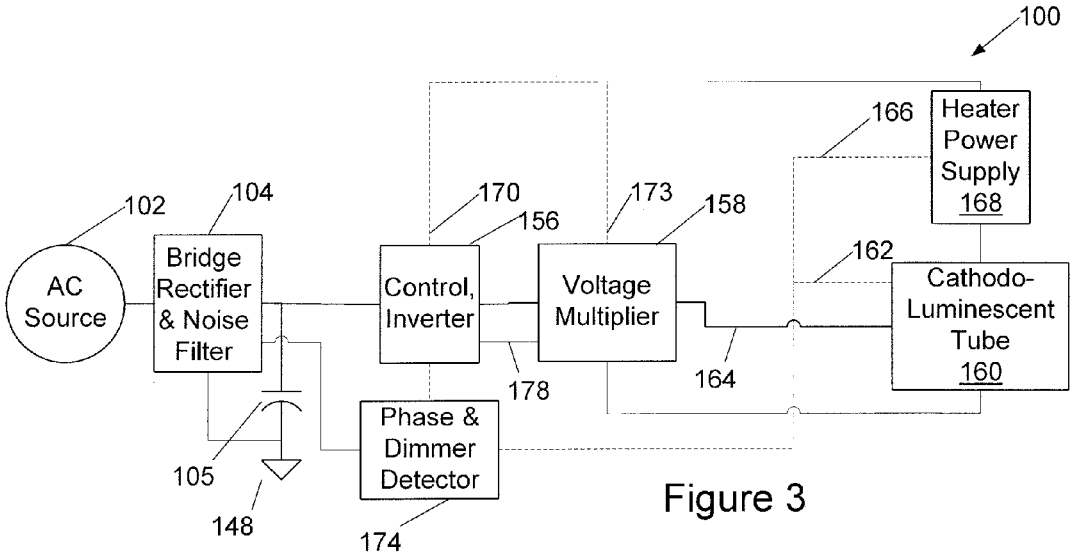
FIG. 3 is a schematic diagram of the lighting system of FIG. 1 with additional circuitry for power factor correction and dimmer controllability.

FIG. 3 illustrates an embodiment of a lighting system 100 embodying a cathodoluminescent lighting device with additional circuitry for power factor correction and dimmer controllability. In this embodiment, power is supplied by external AC power source 102, otherwise known as mains AC. AC power from power source 102 is rectified by bridge rectifier 104, into DC power with an internal ground 148, and is filtered by a capacitor 105. In embodiments operating from a 120-volt AC power source 102, a resulting DC voltage is approximately 160 volts. In some embodiments, capacitor 105 is undersized such that the resulting DC voltage has substantial ripple, in this embodiment an improved power factor may be seen. In embodiments operating from a 240-volt AC power source, the DC voltage is approximately 320 volts. Filtering components may also be present in bridge rectifier 104 block to prevent undesirable emissions, such as radio frequency noise from a controller-inverter unit 156, from being coupled back into power source 102.

The DC power from rectifier 104 and capacitor 105 powers controller-inverter unit 156, to provide high frequency AC power, which in turn feeds a voltage-multiplying rectifier 158 to provide high voltage suitable for anode to cathode power of a cathodoluminescent tube 160.

Cathodoluminescent tube 160 also receives heater power from a heater power supply 168. In some embodiments, heater power supply 168 is inductively coupled 170 to the high frequency AC output to draw power from controller-inverter unit 156. In other embodiments, heater power supply 168 is capacitively coupled 173 to draw power from a node or capacitor (not shown) in voltage multiplier 158.

In embodiments having power factor correction and/or dimmer controllability, a phase and dimmer detector 174 may be coupled through rectifier 104 to monitor incoming power. In embodiments having power factor correction, controller-inverter unit 156 may respond to a phase detected by phase and dimmer detector 174. In embodiments having dimmer controllability circuitry, controller-inverter unit 156 may respond to detected dimmer settings, as measured by phase and dimmer detector 174, by: altering the AC voltage provided to voltage multiplier 158, thereby altering anode-to-cathode voltages provided to cathodoluminescent tube 160 and tube brightness; or altering an amount of power provided by heater power supply 168 to a cathode heater (not shown) of cathodoluminescent tube 160, thereby altering electron gun emissions and tube brightness.

In many embodiments, AC voltage provided by controller-inverter unit 156 to voltage multiplier 158, or DC voltage tapped from an early stage of voltage multiplier 158, is fed back 178 to the controller-inverter unit 156 to provide a degree of voltage regulation. Such embodiments may thereby stabilize anode-to-cathode voltages provided to the cathodoluminescent tube 160. In some embodiments, phase and dimmer detector 174 modulates either heater power 166 or a grid voltage 162 of cathodoluminescent tube 160.

Figure 2:
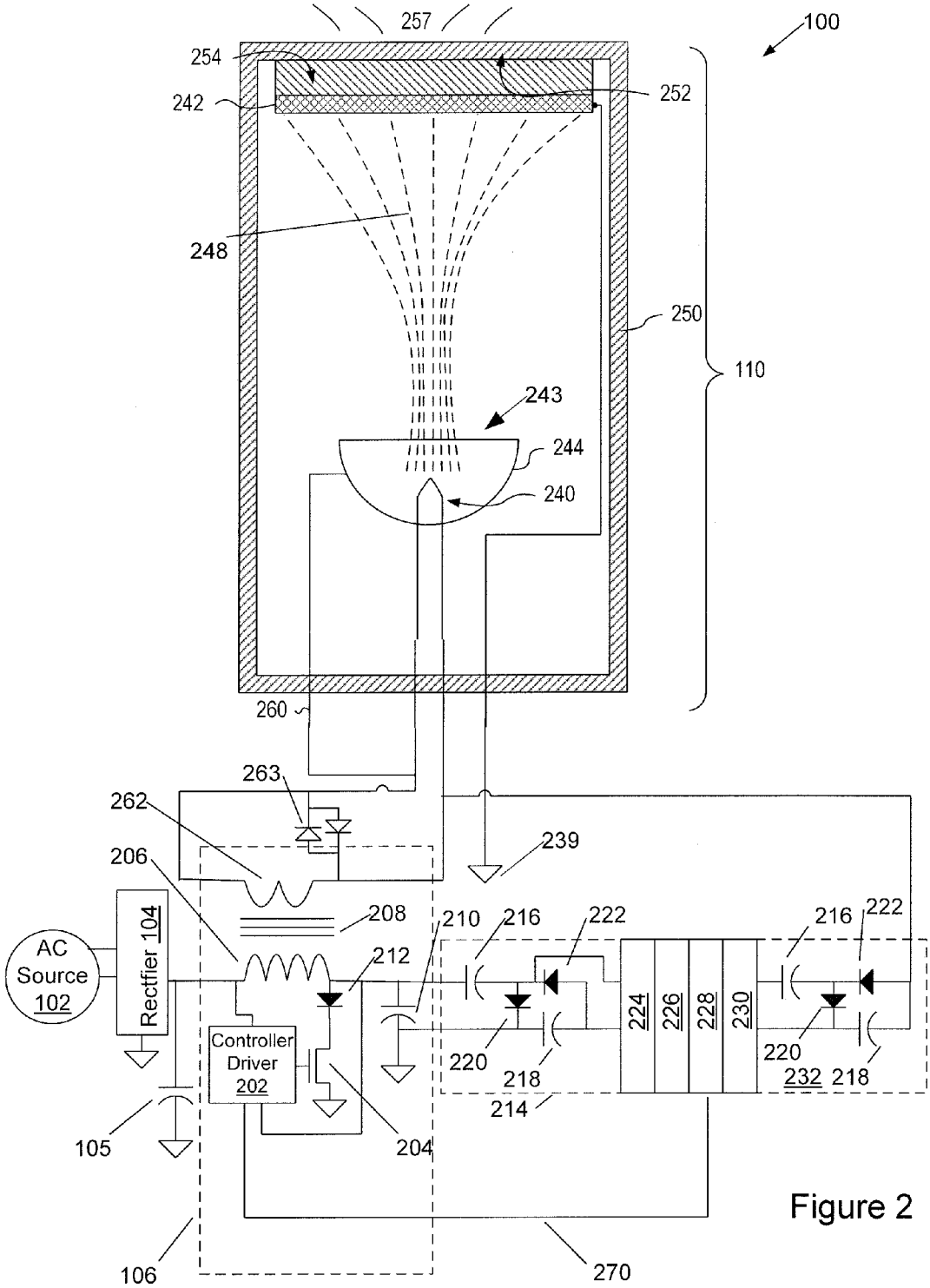
FIG. 2 is a schematic diagram of a lighting system embodying a cathodoluminescent lighting device with thermionic cathode and inverter having an inductor with grounded anode.

An embodiment of cathodoluminescent lighting system 100 of FIG. 1 or FIG. 3 is illustrated in FIG. 2. In this embodiment, controller-inverter unit 106 (indicated as a dashed box) includes a controller-driver 202 that controls a switching transistor 204. Switching transistor 204 may be an NMOS transistor, or may be another suitable switching device such as an NPN or IGBT transistor, as known in the art. As illustrated in FIG. 2, when transistor 204 turns on, a voltage at the output of controller-inverter unit 106 and the input of voltage multiplying rectifier 108 goes to near zero, and current builds up in an inductor 206, which may be wound on a ferrite core 208. Application of current to inductor 206 through transistor 204 is known as "kicking" the inductor. When current reaches a maximum value determined by controller-driver 202, which is determined by an effective pulse-width of on-time of transistor 204, transistor 204 is turned off. Inductor 206 continues carrying current momentarily, causing the voltage at the input of voltage multiplying rectifier 108 to increase well above the DC voltage at capacitor 105. The voltage at the input of multiplying rectifier 108 may appear across a capacitance that represents an input capacitance of voltage multiplying rectifier 108 in parallel with a small noise-suppression capacitor 210.

When the voltage at the input of multiplying rectifier 108 exceeds the DC voltage at capacitor 105, current in inductor 206 will reverse, eventually driving the voltage at the input of voltage multiplying rectifier 108 below the DC voltage at capacitor 105, and possibly below ground voltage. A current in parasitic junctions of transistor 204, when voltage at the input of multiplying rectifier 108 is below ground voltage, can be suppressed by a diode 212. Inductor 206 may effectively form a series-resonant circuit with the paralleled input capacitance of the multiplying rectifier 108 and noise suppression capacitor 210.

At an appropriate time (preferably synchronized at an appropriate point of the waveform of voltage at the input of voltage multiplying rectifier 108 so that maximum energy is recovered from multiplying rectifier 108 and input capacitance 210), controller-driver 202 turns on switching transistor 204 again to give inductor 206 another increase, thereby sustaining a high-frequency AC signal at the input of multiplying rectifier 108.

The inverter described with reference to inductor 206, transistor 204, and controller-driver 202, is hereinafter referred to as a "resonant-flyback inverter."

Peak current in inductor 206, power drawn from capacitor 105, and therefore peak voltage at the input of multiplying rectifier 108 and output voltage of multiplying rectifier 108, may all be dependent upon the pulserate and pulsewidth of transistor 204.

Alternative embodiments may have other inverter designs than that illustrated in FIG. 2 without departing from the scope of the invention herein. For example, a transformer-coupled inverter may be used, in which a secondary winding coupled to inductor 206 drives voltage multiplying rectifier 108. In yet another embodiment, a traditional class-E stage is used to provide AC power to voltage multiplying rectifier 108.

Voltage multiplying rectifier 108 can be a multistage multiplier resembling the Cockroft-Walton type. A basic stage 214 (indicated by a dashed box) of this unit has a coupling capacitor 216, a filter capacitor 218, and two high voltage diodes 220, 222. DC output of stage 214 is taken at the output side of filter capacitor 218, and DC-offset AC output is taken at coupling capacitor 216. These outputs are then fed into following stages 224, 226, 228, 230, 232. The number of stages in multistage voltage multiplying rectifier 108 may vary with a choice of AC source 102 line voltage, as well as desired operating conditions, including an anode 242-cathode 240 operating voltage of cathodoluminescent tube 110 and characteristics of controller-inverter unit 106. For example, a cathodoluminescent device for operation on a 230 volt AC source 102 as is commonly available in England may require fewer stages in the multistage voltage multiplying rectifier than a cathodoluminescent device for operation on a 115 volt AC source 102 as is commonly available in the United States.

Internal ground voltage and an output voltage of final stage 232 of voltage multiplying rectifier 108 is coupled to provide a high voltage between anode 242 of cathodoluminescent tube 110 and cathode 240 of tube 110, such that anode 242 is seen as positive by between two kilovolts and thirty kilovolts with respect to cathode 240. In FIG. 2, cathode 240 is shown to be driven between two kilovolts and thirty kilovolts negative with respect to an internal ground 239 and anode 242. However, in an alternative embodiment having a different voltage multiplying rectifier 108, cathode 240 is at the voltage of internal ground 239, with anode 242 being driven between two kilovolts and thirty kilovolts positive with respect to internal ground 239. The differences in voltage between anode 242 and cathode 240, and any reflector electrode bias voltage, is more significant to lighting device operation than voltages with respect to internal ground 239 or any external ground. In other embodiments, anode 242 is fourteen to sixteen kilovolts positive with respect to cathode 240.

Embodiments having cathode 240 below internal ground voltage, and anode 242 at internal ground voltage, may be utilized. It is expected that in the event of an envelope 250 fracture, cathode 240 will be less likely to contact a living creature or human than the relatively large anode 242. In an embodiment, internal ground 239 is connected to a neutral line from AC source 102 for safety when connected to a lighting socket that is correctly wired. For safety when the device is coupled to an incorrectly-wired AC source 102, internal ground 239 may be connected to the neutral line of AC source 102 through a high value resistor to limit current.

Cathode 240 is part of an electron flood-gun 243, for emitting a broad, unfocused, beam 248 of electrons, such that the voltage difference between anode 242 and cathode 240 may accelerate the electrons towards anode 242. Electron flood-gun 243 has in many embodiments a reflector electrode 244. Anode 242 is a thin, light-reflective layer of metal such as aluminum. Electron gun 243 and anode 242 are contained within evacuated envelope 250. Envelope 250 is fabricated of a nonporous material such as glass and has a transparent or translucent faceplate 252. Layered between anode 242 and faceplate 252 is at least one layer 254 of a phosphor material, as known in the art of cathode-ray tube displays, and chosen for desired spectral characteristics of light 257 to be emitted through faceplate 252 by operation of cathodoluminescent lighting system 100. A thin, temporary, "lacquer" layer may be used between phosphor layer 254 and anode layer 242 in manufacture to prevent diffusion of anode layer 242 into phosphor layer 254 and enhance reflectivity of anode layer 242. Anode layer 242 is thin enough to permit most electrons striking it to either pass through it into phosphor layer 254, or to scatter additional electrons from anode 252 into phosphor layer 254

Alternative embodiments (not shown) may utilize an anode having a thin, transparent, conductive anode layer adjacent to faceplate 252, this anode layer in turn being coated with the phosphor layer.

Referring again to FIG. 2, cathode 240 is a hot, thermionic, self-heated, thoriated tungsten-filament cathode 240. Cathode 240 requires from half a watt to two watts of power to operate.

The power supply includes a heater power supply for powering cathode 240 filament. In FIG. 2, a winding 262, magnetically coupled through core 208 to inductor 206, is shown as providing power to cathode 240. In this embodiment, clamp diodes 263 or other circuitry is provided to limit and regulate heater voltage and current. In an embodiment, heater current is provided to cathode 240 by an integrated-circuit regulator at a first level when the system 100 is first turned on, this current being reduced to a second level for continuing operation once cathode 240 reaches an appropriate operating temperature. Additional circuitry is provided to allow for sustained or increased heater current during a warmup time when system 100 is first turned on.

The power supply, including voltage-multiplying rectifier 108 and controller-inverter unit 106, is assembled using integrated circuit and surface-mount technology as known in the art, and potted with a suitable high-voltage potting compound to prevent arcing.

In embodiments, a voltage from a filter capacitor (not shown) of voltage-multiplying rectifier 108 is tapped and fed back 270 through a resistive divider (not shown) to controller-driver 202 of inverter 106, such that an accelerating potential difference between anode 242 and cathode 240 is maintained at a desirable level. In an alternative embodiment, feedback control of controller-inverter unit 106, through adjustment of pulse rate and pulsewidth at transistor 204, permits operation of cathodoluminescent lighting system 100 on AC source voltages ranging from 110 to 250 volts, and 50 to 60 hertz, so as to operate on 120-volt AC voltage common to the United States, or on 240-volt AC voltage common to many European countries.

Figure 4:
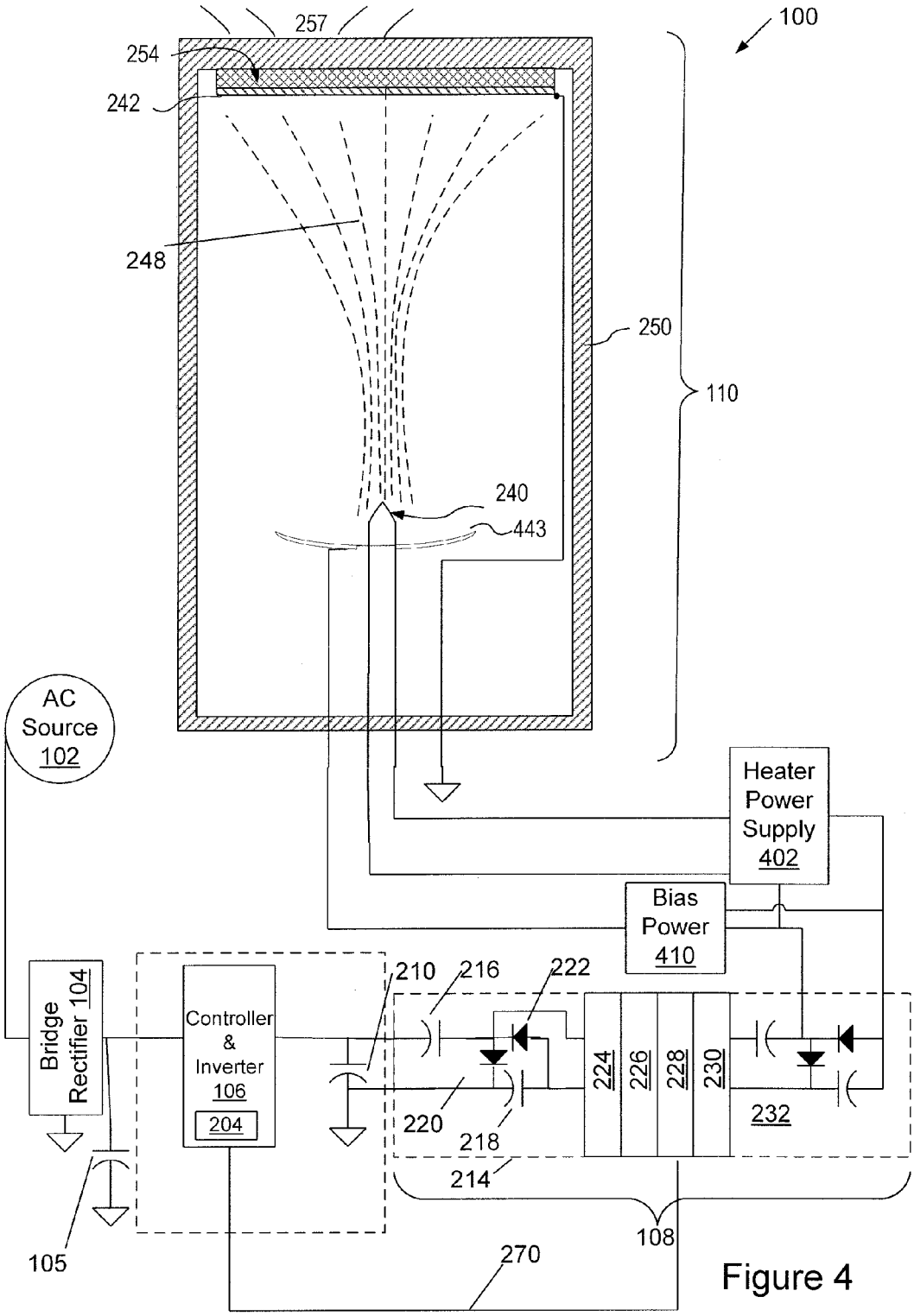
FIG. 4 is a schematic diagram of a lighting system embodying a cathodoluminescent lighting device with thermionic cathode and a separate downconverter, and an inverter having an inductor with grounded cathode.

Referring now to FIG. 4, an embodiment of cathodoluminescent lighting system 100 may have a differently-shaped reflector electrode 443 and a reflector bias supply 410. In this embodiment, operation of bridge rectifier 104 and controller-inverter 106 (which is for example a resonant inverter) is essentially equivalent to operation of the similar circuits of FIG. 2, and are thus not separately described.

While some embodiments similar to that of FIG. 4 may use an inductively coupled heater supply similar to that of FIG. 2, in the embodiment illustrated in FIG. 4, an AC signal is tapped from voltage multiplying rectifier 108 to provide power to a heater power supply 402 for powering a filament of cathode 240. Similarly, the AC signal tapped from voltage multiplying rectifier 108 may be used to provide power to a bias supply 410 for biasing reflector electrode 443.

The embodiment of FIG. 4 may optionally be provided with a dimmer detector (not shown) that monitors a duty cycle of incoming AC power source 102.

In yet another embodiment, which need not have a dimmer detector, controller-inverter 106 maintains approximately constant pulsewidth of switching device 204 of controller-inverter 106. In this embodiment, assuming a large capacitor 105, acceleration voltage may vary roughly proportionately with DC voltage at capacitor 105. While the voltage remains approximately constant while the input AC power contains more than half of each half-cycle of mains AC, as an external dimmer cuts the input AC to less than half of each half-cycle, the voltage at capacitor 105 may drop with decreasing pulsewidth of the incoming AC, with a result that acceleration voltage may decrease and brightness may dim.

In cathodoluminescent lighting device 100, for optimum light emitting efficiency, as much as possible of the area of phosphor coating 254 and anode 242 on faceplate 252 is illuminated evenly by electron beam 248. It may is wasteful for electron beam 248 to extensively irradiate other portions of envelope 250. In some embodiments, electron gun 243 emits an even, broad, symmetrical beam of at least sixty, and in some embodiments ninety or more, degrees in width.

Figure 5:
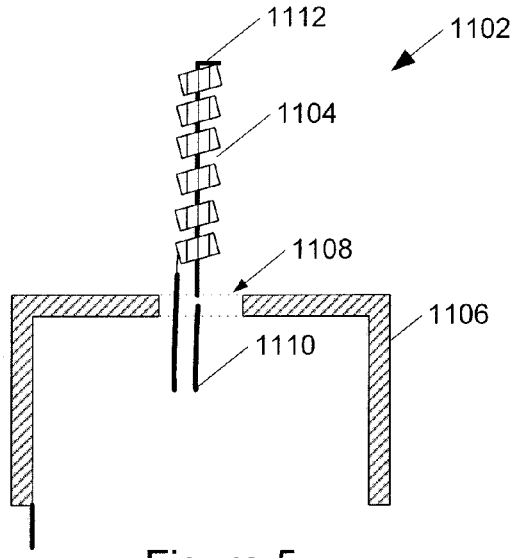
FIG. 5 is a cross-sectional illustration of a tubular coiled-tungsten direct-heated cathode and inverted-cup reflector for use in a cathodoluminescent lighting device.
Figure 6:
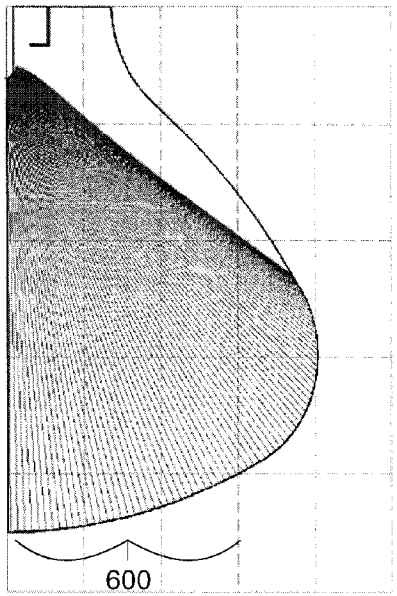
FIG. 6 is a simulated electron trajectory pattern for the cathode of FIG. 5.

In some embodiments, reflecting electron guns have been found suitable to produce such a broad, even beam. Many of these reflecting electron guns are operated with an emissive, heated cathode located on the anode side of a reflecting element, with the reflecting element biased at a predetermined voltage with respect to the cathode In an embodiment, as illustrated in the cross-sectional diagram of FIG. 5, an electron gun 1102 has a heated, rodlike thermionic cathode 1104 of 0.08 inches in diameter, and having a rounded end with radius of 0.04 inches. A reflecting electrode 1106 is fanned from a cap of approximately 0.520 inches in diameter, and having a central hole 1108 measuring approximately 0.150 inches in diameter, in which cathode 1104 is centered. Hole 1108 is made as small as practical such that the electrostatic reflecting field created by reflecting electrode 1106 is not disrupted by its presence, yet large enough to avoid reflecting electrode 1106 and its connections contacting cathode 1104. Cathode 1104 may extend through hole 1108, or may be located in front of reflecting electrode 1106 and be powered by leads 1110 extending through hole 1108. Such configurations may prevent disruption of the emitted electron pattern by avoiding leads and wires on the anode side of the electron gun. Approximately the most distal 0.166 inch of a filament 1112 of cathode 1104 is thoriated or coated with other emissive material. The rear of the emissive surface of the cathode is 0.05 to 0.25 inches, and may be about 0.126 inches, past central hole 1108 of reflecting electrode 1106. A simulated emission pattern from cathode 1104 is illustrated in FIG. 6.

Similar embodiments may have a reflecting electrode cap 1106 diameter of 0.5 to 0.75 inches, with central hole 1108 being in the range from 0.050 to 0.200 inches in diameter.

Cathode 1104 may be a thorium- or other emissive material-treated filament coiled and formed to have a desired shape. Simulations of cathode 1104, in a cathodoluminescent tube having anode potential of 14.5 to 16 KV positive with respect to the cathode, show an electron beam pattern 600 as illustrated in FIG. 6, which produces relatively even illumination of the anode.

Figure 7:
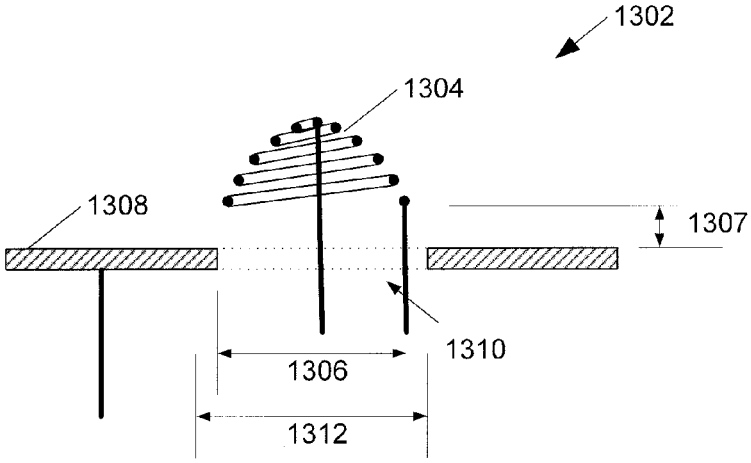
FIG. 7 is a cross-sectional illustration of a hemispherical coiled-filament cathode positioned ahead of a flat plate reflector.

In an embodiment, as illustrated in FIG. 7, an electron gun 1302 has a hemispherical cathode 1304 formed as a thoriated tungsten filament by winding a double-helix filament around a hemispherical mandrel (not shown). The mandrel is removed after the filament is formed. In an alternative embodiment, a hemispherical ceramic body is used in place of the mandrel, and the ceramic body may be allowed to remain in the cathode as a supporting member. Resulting hemispherical cathode 1304 may have a diameter 1306 of about 0.18+/−0.025 inches, and is placed a distance 1307 from 0.05 to 0.2 inches, or about 0.13 inches, in front of a flat plate or planar plate reflector 1308. Plate reflector 1308 has a diameter of about 1 inch, and a central hole 1310 with a diameter 1312 of about 0.200 inches. The cathode 1304 may therefore be located in front of reflector 1308 by a distance of approximately three quarters of its diameter. Cathode 1304 is powered by leads (not numbered) protruding through hole 1310 in reflector 1308 to avoid disruption of the electron pattern that may result from leads on the anode side of the electron gun.

Figure 8:
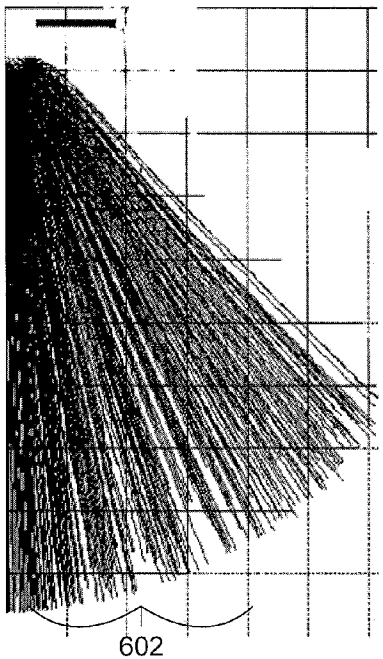
FIG. 8 is a simulated electron trajectory pattern for the cathode of FIG. 7.

Simulations of the embodiment shown FIG. 7, in a cathodoluminescent tube having anode potential of 15 KV positive with respect to the cathode, for example, may show an electron beam pattern 602 as illustrated in FIG. 8, which produces even illumination of the anode.

Similar embodiments may have a reflector 1308 diameter of between 0.5 and 0.75 inches, with a central hole 1310 of about 0.200+/−0.025 inches in diameter Electron gun 1302 may have a thorium-doped filament coiled to have a desired shape. Other emissive materials may be used to dope or coat the filament, and such embodiments may operate with an anode potential of between 2 and 30 KV, and or with an anode potential of 14 to 16 KV.

A variation of electron gun 1302 of FIG. 7 has a curved reflector, as illustrated in FIG. 4, in place of flat reflector 1308 shown in FIG. 7.

Figure 9:
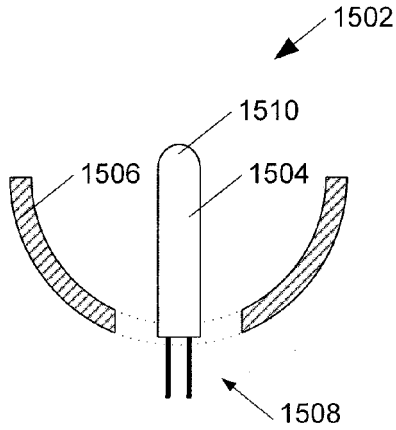
FIG. 9 is a cross-sectional illustration of a cylindrical cathode with a hemispherical reflector.
Figure 10:
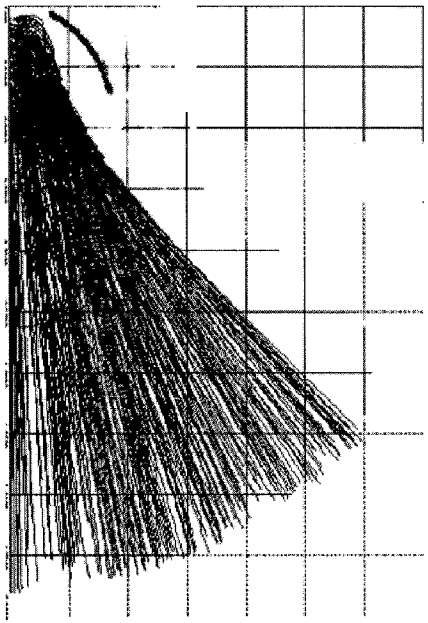
FIG. 10 illustrates a simulated electron trajectory pattern for a variation of the cathode of FIG. 9.

In another embodiment, as illustrated in FIG. 9, a rodlike cathode 1504 of an electron gun 1502 is formed as a coiled, thoriated-tungsten, filament. An embodiment of cathode 1504 is a cylinder having a diameter of between 0.025 inches and 0.150 inches in length, is positioned ahead of a hemispherical reflector 1506 having a diameter of approximately 1 inch, and has a central hole 1508 measuring 0.060 to 0.200 inches in diameter. Cathode 1504 extends through central hole 1508 in reflector 1506. A first simulation of an electron emission pattern from cathode 1504, in a cathodoluminescent tube having anode potential of 15 KV positive with respect to the cathode, is illustrated in FIG. 10. A pattern of this embodiment may produce even illumination of the anode, except for a small central region that may receive somewhat reduced illumination. It is believed that providing an effectively rounded tip 1510 to cathode 1504, by forming the coil with a conical or hemispherical tip section, as illustrated in FIG. 9, may provide adequate, even illumination of the anode.

Curved reflector 1506 need not be exactly hemispherical. For example, curved reflectors having parabolic shapes may provide essentially equivalent performance.

Figure 11:
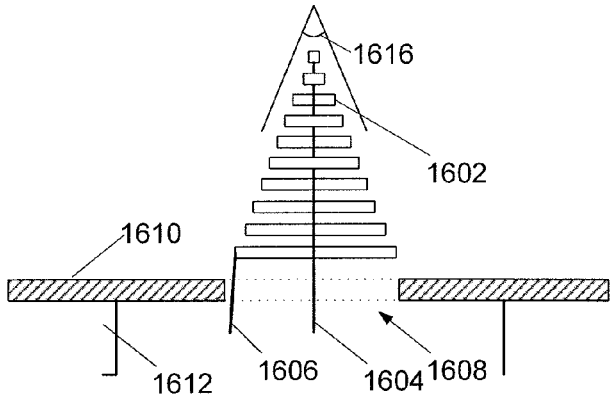
FIG. 11 illustrates a conical cathode with a flat reflector.

Similar embodiments may have a reflector 1506 diameter of 0.5 to 0.75 inches, with central hole 1508 in the range from 0.050 to 0.200 inches in diameter Referring to FIG. 11, an embodiment has a coiled-filament cathode 1602 formed into a conical shape with a point facing the anode (not shown). Cathode 1602 may be formed from thoriated tungsten wire, for example. Cathode 1602 may be supported on a central wire 1604 and a peripheral wire 1606 protruding through a central hole 1608 in a reflector 1610. Reflector 1610 may also be supported by support wires 1612. Reflector 1610 may be electrically connected to cathode 1602, and the filament of cathode 1602 may be heated by a power supply (not shown) outputting about one volt.

In an embodiment, the conical shape of cathode 1602 forms an angle 1616 of between ten and forty degrees.

Cathode 1602 may further have a thorium-doped filament (not shown) coiled to have a desired shape. Other emissive materials may be used to dope or coat the filament. Such embodiments may operate with an anode potential of about 14.5 to 16 KV.

The embodiments of FIGS. 5 through 10 may not only provide a broad electron beam of at least sixty, and in most embodiments ninety, degrees in width, but may also provide relatively even illumination of the anode. Furthermore, no mesh grid or control grid would be required between the cathode and anode.

Since electrons are repelled by negative charges, such that their trajectories may be deflected from negatively charged surfaces, in an embodiment similar to the embodiments of FIGS. 5 through 10, a reflector is biased negatively with respect to the cathode. In such embodiments, reflectors 1106, 1308, 1506, 1610, for example, are not electrically connected to cathodes 1104, 1304, 1504, 1602, respectively, but instead are connected to an appropriate bias voltage supply driven from a voltage multiplying rectifier, such as elements 108, 158. Electrons passing from one of cathodes 1104, 1304, 1504, 1602 to anode 242 may have trajectories that converge or cross over before diverging to evenly illuminate the anode 242.

Figure 12:
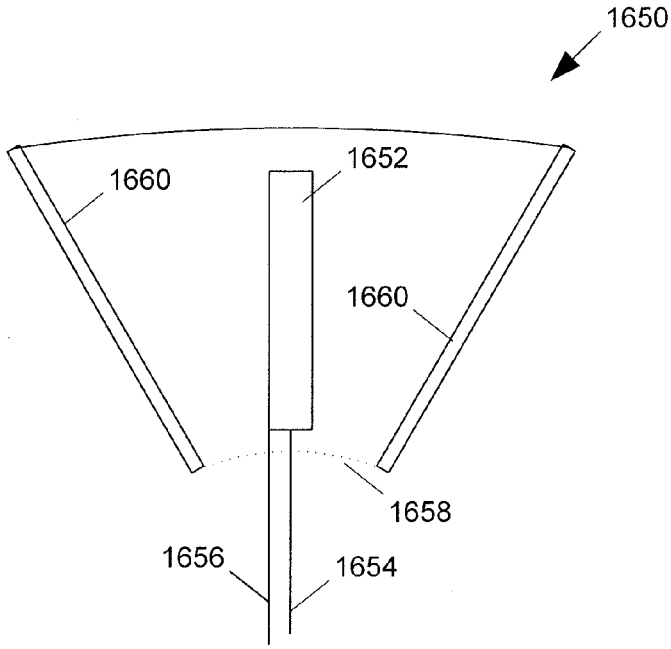
FIG. 12 illustrates a cross-sectional illustration of a tubular coiled-tungsten direct-heated cathode and truncated cone reflector for use in a cathodoluminescent lighting device.

Referring now to FIG. 12, an emitter 1650 has a central thermionic cathode 1652 of an approximately rodlike shape, and which may be approximately 0.150 inches long. Cathode 1652 may be a coiled thoriated-tungsten filament connected to a first and a second support (not shown) and/or electrical connection wires 1654, 1656. Cathode 1652 may also have an insulating post (not shown), such as a ceramic rod, along its axis (not numbered) to provide mechanical support for its filament (not shown).

Cathode 1652 has a longitudinal axis (not numbered) centered in a hole 1658 at a narrow end (not numbered) of an axially symmetric reflector and/or secondary emitter electrode 1660, which may have a concave and/or truncated-cone shape. Cathode 1652 may be located approximately 0.02 inches forward of hole 1658 in the reflector and/or secondary emitter electrode 1660.

In an embodiment, reflector and/or secondary emitter electrode 1660 has an interior surface coated with a material (not shown), such as magnesium oxide, which may have good secondary electron-emission qualities. In operation, reflector and secondary emitter electrode 1660 is forward biased at a voltage that provides advantageous steering of electrons emitted by cathode 1652 toward reflector 1660. Secondary electrons are then emitted when electrons from cathode 1652 strike reflector and/or secondary emitter electrode 1660. Geometry and voltages may then be adjusted to provide advantageous steering of secondary electrons toward the anode for uniform illumination of light producing region.

In an embodiment, reflector and/or secondary emitter electrode 1660 may have a convex shape with a radius of curvature of about 0.5 inches, and having a hole 1658 measuring approximately 0.075 inches in diameter. In an embodiment, reflector and/or secondary emitter electrode 1660 is biased sufficiently positive, such as at one kilovolt, with respect to cathode 1652, so that a reasonable percentage of electrons emitted by cathode 1652 strike secondary emitter electrode 1660 with sufficient energy to cause secondary electron emission. Some remaining electrons from cathode 1552, hereinafter referred to as primary electrons, and the secondary electrons from reflector and/or secondary emitter electrode 1660, are attracted to and illuminate anode 242 of cathodoluminescent lighting device 100. In the embodiment shown in FIG. 12, reflector and/or secondary emitter electrode 1660 may be connected to an appropriate bias voltage supply 410 (e.g., as in FIG. 4) driven from an AC voltage tapped from one of voltage multiplying rectifiers 108, 158, or alternatively may be self-biased positively by a voltage obtained by passing secondary emission current through a resistor (not shown).

While specific dimensions have been given for the electron guns of FIGS. 5 through 12, these exact dimensions represent design choice; it is expected that dimensions of the reflectors and cathodes can be scaled, according to the teachings of this application, to produce similar and/or equivalent electron beam patterns from smaller or larger electron guns.

Figure 13:
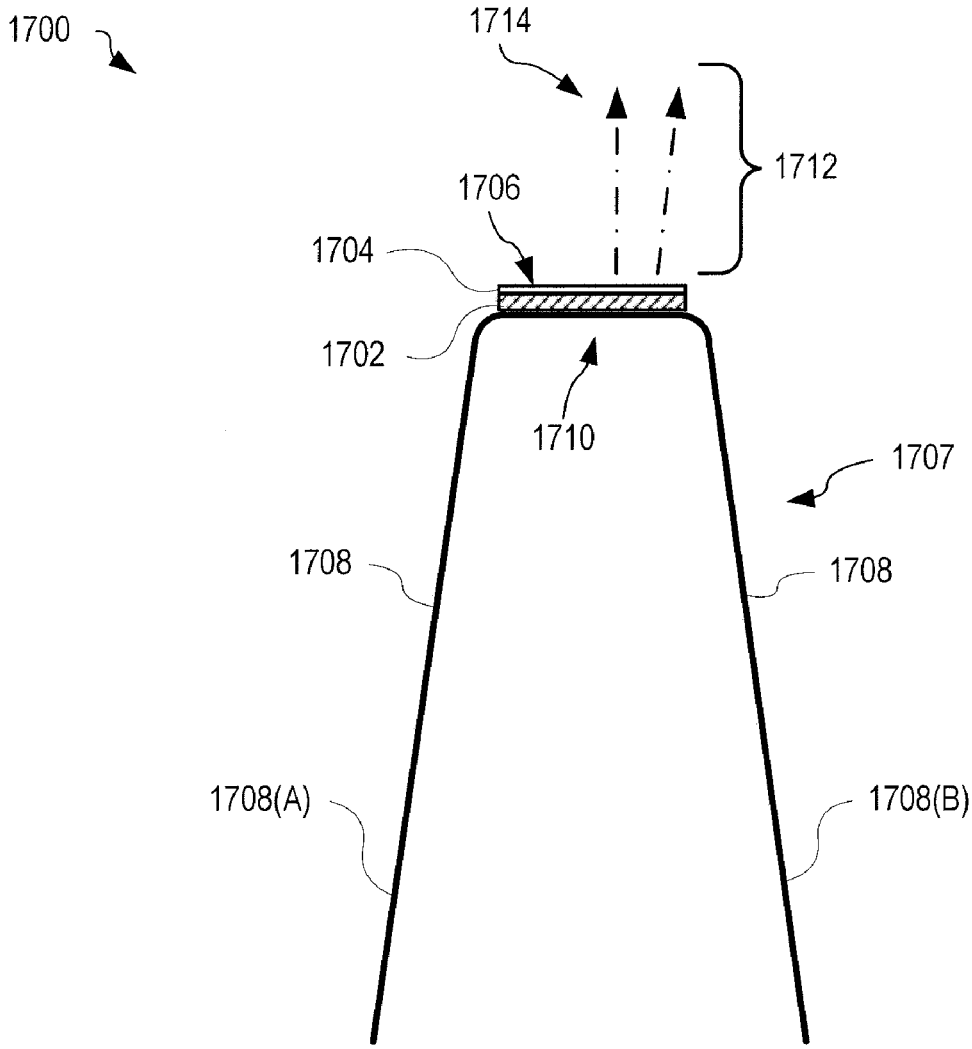
FIG. 13 illustrates an alternative cathode having a discoidal emitter attached to a hairpin filament.

In another embodiment of an electron source, as illustrated in FIG. 13, cathode 1700 has a Nickel (Ni) disk substrate 1702, on which is formed an emissive material 1704 to provide an emissive surface 1706. Emissive material 1704 is, for example, Barium Oxide (BaO); however, other emissive materials may be used without departing from the scope hereof. A disk or alternatively-shaped substrate coated with other theimionically-emissive cathode materials as known in the arts of vacuum tube cathodes and cathode ray tubes may be used without departing from the scope hereof.

A tungsten, or tungsten alloy, wire 1708 is bent to form an inverted 'U' shape with a flat top 1710 to provide a heating element 1707. Substrate 1702 is attached electrically and mechanically to wire 1708 at flat top 1710. For example, substrate 1702 is attached to wire 1708 using one of resistance spot welding, laser welding, brazing, or other attachment processes known in the art. Tungsten wire 1708 incandesces and directly heats substrate 1702 and emissive material 1704. In this example, substrate 1702 and tungsten wire 1708 are also electrically connected. In another embodiment, a simple incandescing tungsten wire having a coating of emissive material, but with no cathode substrate attached, is used for electron emission. Materials other than tungsten may be used and formed other than as wire, without departing from the scope hereof. For example, other resistive materials having suitable high-temperature mechanical strength may be adapted for heating substrate 1702 and emissive material 1704, and may be formed as wire, plate, ribbon, tape, bar, or any other physical configuration.

Emissive material 1704 is for example formed by applying a "Triple Carbonate" (predominantly a Barium Carbonate mixture) to substrate 1702. The Triple Carbonate is converted, under vacuum, to a BaO layer. Emissive material is carefully patterned onto substrate 1702 in order to maximize uniformity, and thereby does not require the use of additional electron-optics to achieve uniformity.

A current is passed through tungsten wire 1708 (i.e., by applying a voltage differential between wire 1708(A) and wire 1708(B)) such that substrate 1702 and emissive material 1704 are directly heated from wire 1708. The current through tungsten wire 1708 may be a direct current (DC), an alternating current (AC), or a pulsed current.

By having substrate 1702 in direct intimate contact with wire 1708, cost and complexity are minimized and a quick start-up time of the associated light emitting device is realized. Thus, the lamp may appear to 'instantly' turn on.

In one example of operation, substrate 1702 and its coating of emissive material 1704 are heated to 900 C. by tungsten wire 1708, and an electric field 1712 is created proximate emissive surface 1706. Electrons, shown as arrows 1714, emitted from emissive surface 1706 result in a total cathode emitter current of approximately 1 mA. The total cathode emitter current may be within a range of between 0.1 mA and 5 mA without departing from the scope hereof. Emitted electrons are allowed to spread, without any focus, into a flood beam having diameter of approximately 100 mm when it strikes a cathodoluminescent phosphor (e.g., phosphor layer 806, FIG. 15) within a light emitting device in which it is installed. The use of a low (e.g., 1 mA) emitter current allows thermionic flood-emission cathode 1700 to operate at a lower temperature (e.g., 900 C) than other known cathodes and thereby maximize operational lifetime of cathode 1700.

Figure 14:
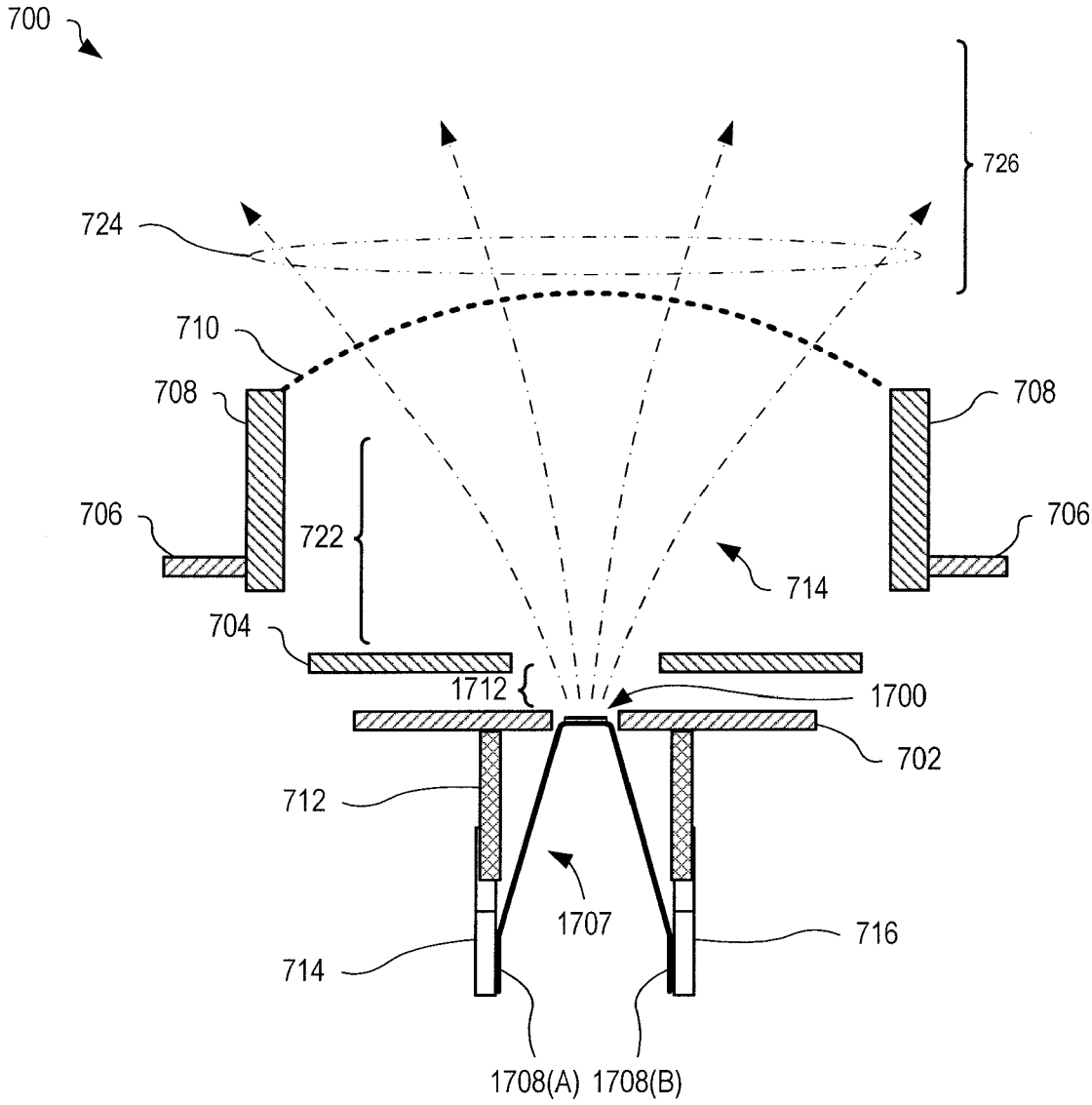
FIG. 14 illustrates the cathode of FIG. 13 in a flood-emission electron gun.
Figure 16:
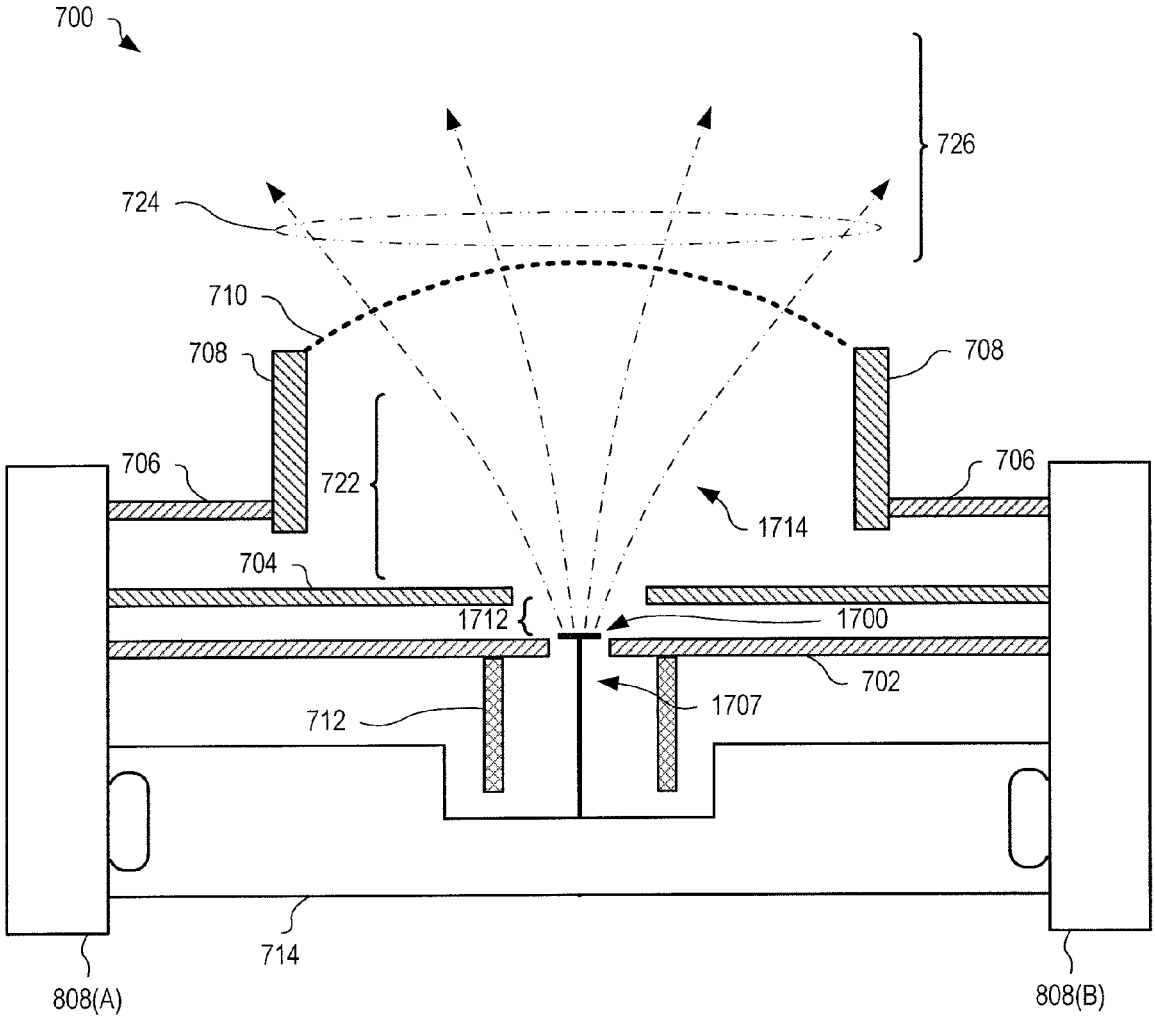
FIG. 16 illustrates the cathode of FIG. 13 in a flood-emission electron gun taken at right angles to the view of FIG. 14.

FIG. 14 shows thermionic flood-emission cathode 1700 of FIG. 13 within an exemplary multiform assembly 700 that includes a metal suppressor or guard ring 702, a metal extraction ring 704, a metal field-forming ring 706, a metal support ring 708, and a metal diffusing grid 710 (e.g., a metal cloth mesh). FIG. 16 shows a side view of the multiform assembly 700 of FIG. 14. Assembly 700 is adapted to high-volume manufacture by being constructed of parts that are formed into a single unit prior to installation within a light emitting device. FIGS. 14 and 16 are best viewed together with the following description.

A first metal heater bar 714 attaches to a wire portion 1708(A) of heating element 707 and a second metal heater bar 716 attaches to a wire portion 708(B) of heating element 707. Attachment of wire portions 708(A) and 708(B) is by one of resistance spot welding, laser welding, brazing, or other known methods of connecting. Metal of components 702, 704, 706, 708, 710, 712 714 and 716 may be fabricated from one of more of stainless steel, molybdenum and nickel, Inconel® and other materials having similar properties.

Metal guard ring 702 is supported by support ring 712 and held at substantially the same potential as, or at a more negative potential than, cathode 1700. Metal guard ring 702 shields the sides of cathode 1700 from undesired electrical fields. Metal extraction ring 704 is held at a potential higher than that of cathode 1700 to form an electric field 1712 that causes electrons to be emitted from emissive surface 1706 of cathode 1700 (see FIG. 13) and accelerated away therefrom. Metal field-forming ring 706 has a potential equal to or higher than metal extraction ring 704 and creates an electric field 722 that spreads (i.e., diffuses) the electrons emitted from cathode 1700 to a flood configuration for use within a light emitting device (e.g., light emitting device 800, FIG. 15). Metal support ring 708 attaches to metal field-forming ring 706 and supports metal diffusing grid 710, which has the same potential as metal field-forming ring 706 and metal support ring 708. Metal diffusing grid 710 shapes electric field 722 such that electrons 1714 emitted from cathode 1700 form a uniform and properly patterned electron beam 724. Electrons 714 are transmitted through metal diffusing grid 710 with minimal interception or secondary electron formation. A third electric field 726 accelerates electrons 1714 towards an anode (see anode 804, FIG. 15), not shown in FIG. 14, and is generated by applying a potential to the anode that is greater than the potential of metal diffusing grid 710.

Metal components 702, 704, 706 and 714 are secured in position by two opposed dielectric attachment bars (not shown in FIG. 14, see dielectric attachment bars 808(A) and 808(B), FIG. 16) to form multifoiin assembly 700. Dielectric attachment bars 808(A) and 808(B) may be made of ceramic or glass. However, other dielectric materials, such as mica, may be used without departing from the scope hereof.

Assembly 700 functions as an electron source within a light emitting device. Optionally, metal guard ring 702 may be omitted where greater precision is used in forming emissive material 1704 on substrate 1702. Further, metal components may also be made three dimensional in order to minimize size, for example. Three dimensional shaping of components may also be used to optimize electric field confinement. Metal components 702, 704, 706, 712 and 714 (both flat and three dimensional) may be manufactured inexpensively from sheet metal using a stamping technology.

Figure 15:
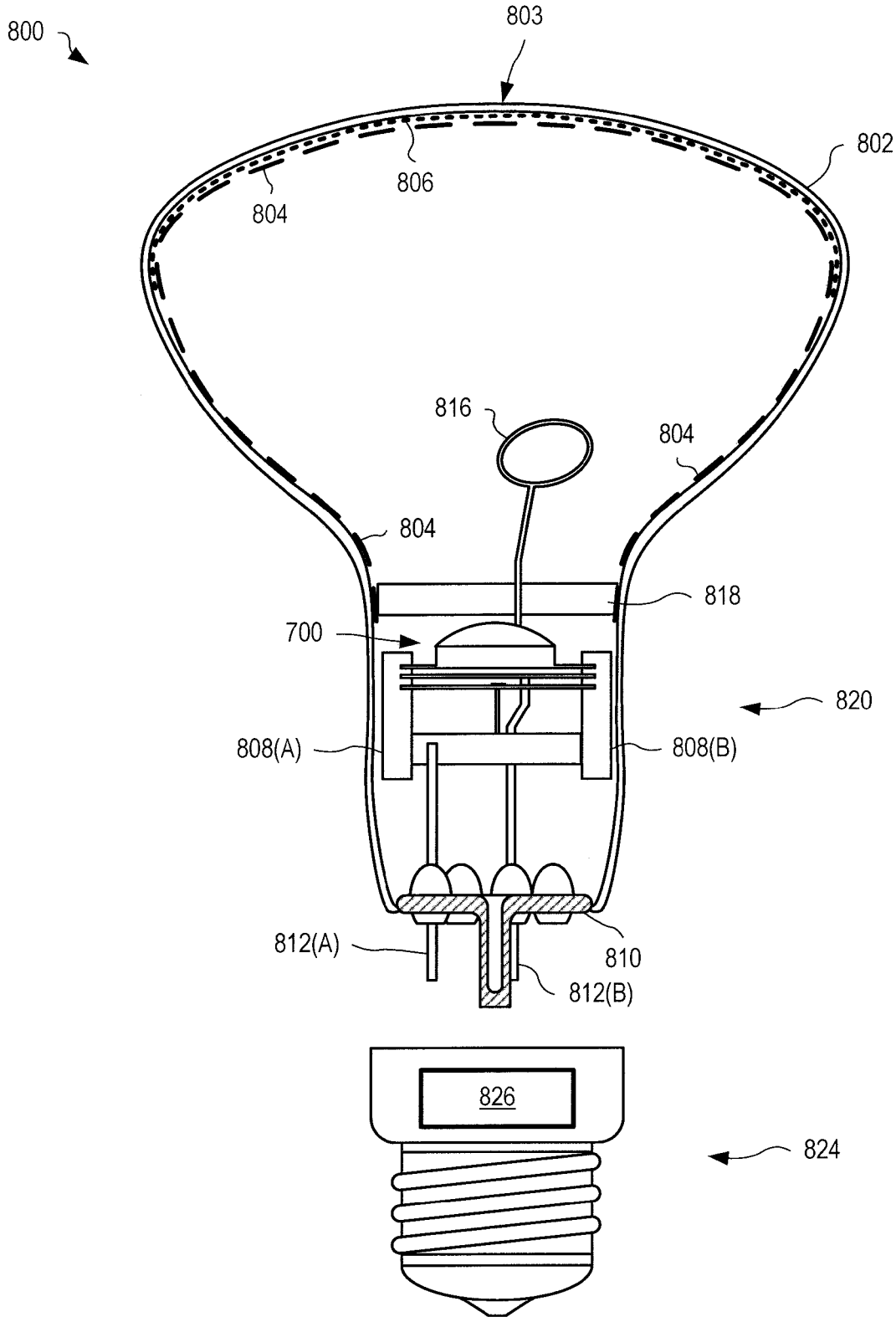
FIG. 15 illustrates a light emitting device embodying the electron gun of FIG. 14.

FIG. 15 shows one exemplary light emitting device 800 incorporating the multiform assembly 700 of FIG. 14. Lighting device 800 includes a transparent envelope 802 and a base section 824. Transparent envelope 802 is for example glass.

Envelope 802 has a face portion 803 through which light is emitted during operation of light emitting device 800 when used to form a light emitting device (e.g., light emitting device 800, FIG. 15). An inner surface of face portion 803 of envelope 802 is coated with a phosphor layer 806. Envelope 802 has a feedthrough base 810 that is formed with a plurality of electrical conductors 812 (only conductors 812(A) and 812(B) are shown for clarity of illustration) that pass from the inside to the outside of envelope 802. Multiform assembly 700 attaches to internal ends of conductors 812 of feedthrough base 810 such that conductors 812 support assembly 700. For example, conductor 812(A) is shown attached to and supporting heater bar 714, and conductor 812(B) is shown attached to and supporting metal extracting ring 704. Since assembly 700 is connected together by dielectric attachment bars 808, assembly 700 is fully supported by conductors 812. In one example, conductors 812 are approximately 1 mm in diameter. Feedthrough base 810 may be formed together with multiform assembly 700 prior to forming envelope 802. Assembly 700 also includes an anode connector spring 818 that electrically contacts a mirror anode 804 formed within envelope 802 over phosphor layer 806 and towards a neck 820 of envelope 802. Each of spring 818, cathode 1700, metal guard ring 702, metal extraction ring 704 and metal field-forming ring 706 may connect to conductors 812 such that potentials of anode 804, cathode 1700, metal guard ring 702, metal extraction ring 704 and metal field-forming ring 706 may be controlled. Optionally, a getter ring 816 is formed to support a getter material within envelope 802 and connects to one or more of conductors 812 to allow activation and removal of stray gas from the interior of the envelope. Shapes other than the illustrated ring may be used for the getter without departing from the scope hereof.

Base section 824 provides electrical connectivity (shown as an Edison thread in this example) to an external source of electricity and may include one or more power converters 826 (and/or other electronic circuitry) for supplying appropriate potentials to spring 818, cathode 1700, metal guard ring 702, metal extraction ring 704, and metal field-forming ring 706, and thereby operating light emitting device 800 to produce light.

The use of assembly 700 within light emitting device 800 is believed to be unique.

While the foregoing disclosure has been shown and described with reference to particular embodiments hereof, it will be understood by those skilled in the art, after reading and comprehending the present application, that various other changes in the form and details may be made without departing from the scope or spirit hereof. It is to be understood that various changes may be made in adapting the description to different embodiments without departing from the broader concepts disclosed herein, and encompassed by the claims that follow.

What is claimed is:

1. A direct-heated thermionic flood-emission cathode for use in a light emitting device, comprising:

a heating element having an inverted "U" shape with a flat top;

a substrate having a first surface attached to the flat top of the heating element and a second surface opposite the first surface; and an emissive material formed on the second surface;

wherein a current through the heating element generates sufficient heat to directly heat the substrate and emissive material such that electrons may be extracted from the emissive material to impact a phosphor layer of the light emitting device.

2. The direct-heated thermionic flood-emission cathode of claim 1, wherein the substrate is a disk, and the second surface is substantially flat.

3. The direct-heated thermionic flood-emission cathode of claim 1, wherein the emissive material comprises Barium Oxide.

4. The direct-heated thermionic flood-emission cathode of claim 3, wherein the emissive material is formed from a Barium Carbonate mixture that is converted into material comprising Barium Oxide within a vacuum.

5. The direct-heated thermionic flood-emission cathode of claim 1, wherein the emissive material is formed only on the second surface.

6. The direct-heated thermionic flood-emission cathode of claim 1, wherein the heating element comprises tungsten.

7. A direct-heated thermionic flood-emission cathode for use in a light emitting device, comprising:

a heating element;

a substrate having a first surface attached to the heating element and a second surface opposite the first surface, the substrate and the heating element being electrically connected; and an emissive material formed on the second surface;

wherein a current through the heating element generates sufficient heat to directly heat the substrate and emissive material such that electrons may be extracted from the emissive material to impact a phosphor layer of the light emitting device.

8. The direct-heated thermionic flood-emission cathode of claim 7, wherein the substrate is a disk, and the second surface is substantially flat.

9. The direct-heated thermionic flood-emission cathode of claim 7, wherein the emissive material comprises Barium Oxide.

10. The direct-heated thermionic flood-emission cathode of claim 7, wherein the emissive material is formed only on the second surface.

11. The direct-heated thermionic flood-emission cathode of claim 7, wherein the heating element comprises tungsten.

12. A light emitting device, comprising:

a multiform assembly comprising:

a cathode comprising:

a heating element, a substrate having a first surface attached to the heating element and a second surface opposite the first surface, and an emissive material formed on a second surface of the substrate opposite the first surface;

a first and second metal heater bars for electrically connecting to and supporting the heating element;

a metal extraction ring aligned with the emissive material;

a metal field-forming ring aligned with the metal extraction ring and positioned further from the emissive material than the metal extraction ring;

a metal grid having a convex shape and a substantially uniform distance from the emissive material, the metal grid being positioned further from the emissive material than the metal field-forming ring;

a metal support ring attached to the metal field-forming ring for supporting the metal grid; and a first and second dielectric bar for supporting the first and second heater bars, the metal guard ring, the metal extraction ring, and the metal field-forming ring; and an envelope forming an evacuated enclosure for containing the cathode and the multiform assembly, the envelope having an anode formed on an inner front transparent face of the envelope and a plurality of electrical feeds that pass through the envelope.

13. The light emitting device of claim 12, wherein the heating element is formed into an inverted "U" shape having a flat top, the substrate being attached to the flat top.

14. The light emitting device of claim 12, wherein the emissive material is formed only on the second surface.

15. The light emitting device of claim 12, further comprising a metal guard ring aligned with the emissive material and positioned between the emissive material and the metal extraction ring.

16. An electron source for use in a light emitting device, comprising:

a direct-heated thermionic flood-emission cathode;

a first metal heater bar attached to a first end of a heating element of the direct-heated thermionic flood-emission cathode;

a second metal heater bar attached to a second end of the heating element;

a metal extraction ring aligned with an emissive surface of the direct-heated thermionic flood-emission cathode;

a metal field-forming ring aligned with the metal extraction ring and positioned further from the emissive surface than the metal extraction ring;

a metal diffusing grid having a substantially convex shape and a substantially uniform distance from the emissive surface, the metal diffusing grid being positioned further from the emissive material than the metal field-forming ring;

a metal support ring, attached to the metal field-forming ring, for supporting the metal diffusing grid; and first and second dielectric attachment bars positioned on opposite sides of the first and second heater bars, the metal extraction ring, and the metal field-forming ring, to hold the first and second heater bars, the metal extraction ring, and the metal field-forming ring in position relative to one another.

17. The electron source of claim 16, wherein the first metal heater bar, the second metal heater bar, the metal extraction ring, the metal field-forming ring, the metal diffusing grid, and the metal support ring each comprise one of stainless steel, molybdenum and nickel.

18. The electron source of claim 16, further comprising a metal guard ring substantially aligned with the emissive surface and surrounding a circumference of the emissive surface.

19. A light emitting device, comprising:

an electron source including:

a cathode, comprising:

a heating element, a substrate having a first surface attached to the heating element and a second surface opposite the first surface, and an emissive material formed on the second surface;

first and second metal heater bars for electrically connecting to and supporting the heating element;

a metal extraction ring aligned with the emissive material;

a metal field-forming ring aligned with the metal extraction ring and positioned further from the emissive material than the extraction ring;

a metal diffusing grid having a substantially convex shape and a substantially uniform distance from the emissive material, the metal diffusing grid being positioned further from the emissive material than the metal field-forming ring;

a metal support ring attached to the metal field-forming ring and supporting the metal diffusing grid; and first and second dielectric attachment bars for supporting the first and second heater bars, the metal extraction ring, and the metal field-forming ring; and a transparent envelope forming an evacuated enclosure for containing the electron source, the transparent envelope having an anode formed on an inner front transparent face of the envelope and a plurality of electrical feeds that pass through the envelope to connect to and support the electron source.

20. The light emitting device of claim 19, the electron source further comprising a metal guard ring substantially aligned with the emissive material and positioned between the emissive material and the metal extraction ring, the metal guard ring being supported by the first and second dielectric attachment bars.

21. The light emitting device of claim 12 further comprising a power supply adapted to provide at least two thousand volts between the anode and the cathode, and adapted to hold the extraction ring at an extraction ring voltage positive with respect to the cathode and the field-forming ring at a voltage equal or higher than the extraction ring voltage.

22. The light emitting device of claim 19 further comprising a power supply adapted to provide at least two thousand volts between the anode and the cathode, and adapted to hold the extraction ring at an extraction ring voltage positive with respect to the cathode and the field-forming ring at a voltage equal or higher than the extraction ring voltage.

23. The electron source of claim 16 further comprising a power supply coupled to hold the extraction ring at an extraction ring voltage positive with respect to the cathode and the field-forming ring at a field ring voltage equal or higher than the extraction ring voltage.

24. The electron source of claim 16 further comprising a diffusing grid, the diffusing grid held at the field ring voltage.

25. The cathode of claim 1 further comprising an extraction ring, a diffusing grid, and a power supply, the power supply coupled to hold the extraction ring at an extraction ring voltage positive with respect to the emissive material, and wherein the diffusing grid has a substantially convex shape and acts to ensure electrons emitted by the cathode form a uniform beam.

26. The cathode of claim 7 further comprising an extraction ring, a diffusing grid, and a power supply, the power supply coupled to hold the extraction ring at an extraction ring voltage positive with respect to the emissive material, and wherein the diffusing grid has a substantially convex shape and acts to ensure electrons emitted by the cathode form a uniform beam.

* * * * *